United States Patent [19]

Babiol

[11] 3,984,022

[45] Oct. 5, 1976

[54] BOTTLE STOPPER

[75] Inventor: Pierre Babiol, Villefranche-sur-Saone, France

[73] Assignee: Le Bouchage Mecanique, Paris, France

[22] Filed: Sept. 5, 1975

[21] Appl. No.: 610,721

[30] Foreign Application Priority Data

Sept. 12, 1974 France ..... 74.31723

[52] U.S. Cl. ..... 215/355

[51] Int. Cl.[2] ..... B65D 39/00

[58] Field of Search ..... 215/355; 220/306, 352, 220/353; 217/78, 110

[56] References Cited

UNITED STATES PATENTS

| | | | |
|---|---|---|---|
| 2,931,230 | 4/1960 | Lowery | 215/355 X |
| 3,006,494 | 10/1961 | Reibeling | 215/355 |
| 3,119,541 | 1/1964 | Lynn | 220/352 X |
| 3,900,122 | 8/1975 | Dichter | 215/355 X |

FOREIGN PATENTS OR APPLICATIONS

| | | | |
|---|---|---|---|
| 181,776 | 5/1936 | Switzerland | 215/355 |

*Primary Examiner*—Donald F. Norton
*Attorney, Agent, or Firm*—Dowell & Dowell

[57] ABSTRACT

A bottle stopper of generally biconical configuration consisting of two truncated conical sections abutting on their bases. The stopper is formed from foamed plastic with a dense outer layer enclosing a closed cellular or honeycomb structure around the center. The height of each truncated conical section is greater than the distance between the neck opening and zone of minimum diameter in conventional bottles and the diameter of the ends of the stopper is less than the diameter of neck opening. The stopper may also be formed with a generally barrel shaped configuration.

5 Claims, 5 Drawing Figures

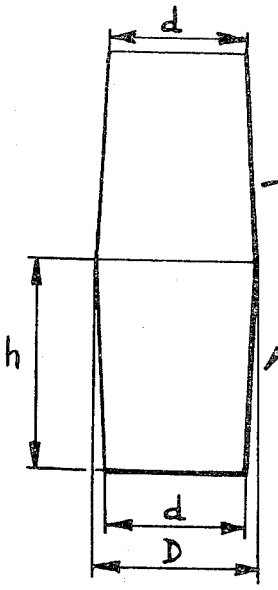
Fig. 1
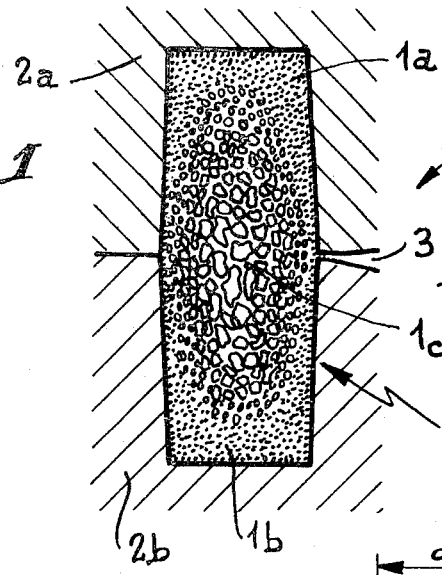
Fig. 2
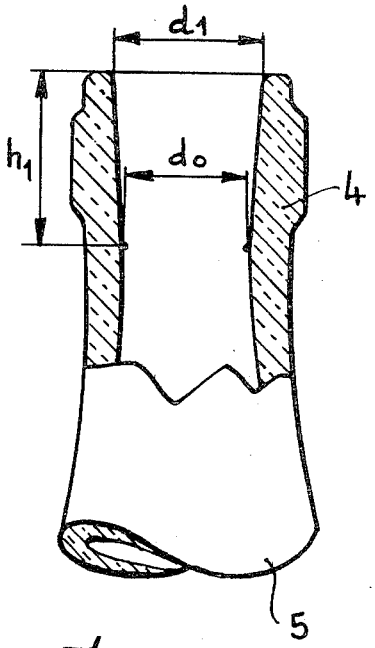
Fig. 3
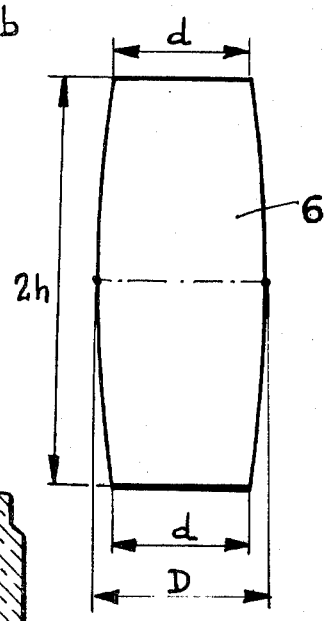
Fig. 5
Fig. 4
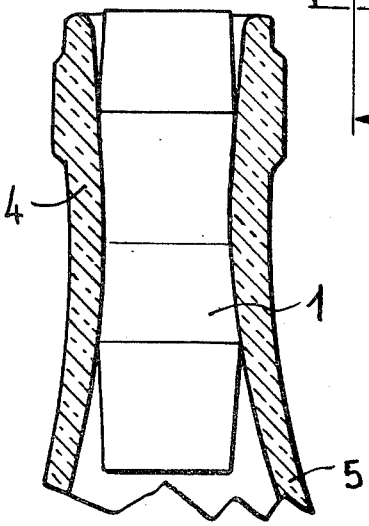

BOTTLE STOPPER

BACKGROUND OF THE INVENTION

The present invention relates to closures for bottles and, in particular, to the type of stopper useful with wine bottles.

It is known to manufacture articles from foamed plastic by injection or extrusion of polyurethane, polystyrene or polyolefin. In the case of injection molding, the grains of plastic material are generally mixed with a pore-forming additive or blowing agent which decomposes at a predetermined temperature, freeing a gas which stays trapped as bubbles in the molded article, forming a closed, cellular or honeycomb structure. Such articles, in particular those formed from polyethylene, have an outer layer in which the pores are of small size, while the density occurring in regions away from the injection point is much greater than that around the injection nozzle.

SUMMARY OF THE INVENTION

In contrast to the prior art, the present invention provides a stopper which meets such differing requirements as providing an impermeable surface in contact with the liquid; having a median zone permitting maximum compression; avoiding crumbling when removed by means of a cork screw; avoiding frictional heating while being installed and avoiding the need for accurate positioning before insertion.

The stopper according to the invention is manufactured from foamed plastic and characterized by a biconical configuration formed from two truncated cones symmetrically arranged with their bases abutting. In forming such a stopper, the injection nozzle is preferably positioned on the plane of the largest diameter so as to ensure the ends of the stopper have a greater density than the central part. Preferably the end diameter of the stopper is selected to be less than the diameter of the neck into which it is to be inserted, while half the height of the stopper is greater than the distance separating the narrowest internal diameter of the neck from its entrance.

BRIEF DESCRIPTION OF THE DRAWINGS

The accompanying drawing is exemplary of two embodiments of the invention:

FIG. 1 is a side view of a stopper according to the first embodiment;

FIG. 2 is a cross-sectional view of a mold for producing such a stopper showing in cross-section, a stopper in the mold cavity;

FIG. 3 shows, in partial section, the neck of a conventional bottle;

FIG. 4 shows the stopper of FIG. 1 positioned in the bottle neck of FIG. 3, and

FIG. 5 is a side view, similar to that of FIG. 1, showing a second embodiment of the stopper of the invention.

DESCRIPTION OF THE PREFERRED EMBODIMENTS

Stopper 1, shown in FIG. 1, is in the form of two truncated conical sections symmetrically arranged with their larger bases abutting. Such a stopper is produced by injection of a plastic material having a pore-forming additive, into a mold 2 provided with hollow cavities in the upper and lower halves 2*a* and 2*b*. The plastic may be a polyolefin such as polyethylene or EVA (ethylene-vinyl-acetate). The cavities together have a dimension equal to that of stopper 1. The plastic material containing the pore-forming additive is injected under heat and pressure into the cavity through one or several injection nozzles 3 located at the junction between the two halves of the mold.

As has been described, when the material is injected into the mold it is important to control its density in the region close to the injection site so that each end of the stopper 1 is formed with a dense layer 1*a*, 1*b* having increased mechanical resistance compared to the material in the center part 1*c* of the stopper, which is of honeycomb or cellular form. It has been found that, in practice, the thicker layers 1*a* and 1*b* have an inward boundary in the stopper of generally parabolic form.

In FIG. 1 reference number $d$ is the diameter of each end of the stopper, D is the diameter of the central part of the medial plane and $h$ is the length of each truncated conical section. Diameter $d$ is chosen to be less than the diameter $d_1$ of the entrance to the neck 4 of bottle 5 (FIG. 3). The diameter D of the stopper on the medial plane is greater than the diameter $d_1$ of the neck entrance of the bottle. The internal diameter of conventional bottle necks decreases from the entrance to provide a minimum diameter $d_0$ less than $d_1$. This reduced diameter $d_0$ is positioned a distance $h_1$ from the entrance to the bottle neck. The half height $h$ of the stopper is chosen to be greater than the distance $h_1$ for reasons set out more fully below.

Because of the symmetrical form of stopper 1, it will be understood that it is not necessary to orient it in a particular fashion before inserting it in the neck of the bottle and it is necessary only to have a dispensing machine position it vertically above the neck. Because diameter $d$ of the end of the stopper is smaller than diameter $d_1$ of the entrance to the neck of the bottle, the stopper can partially engage itself in the neck if the distributing machine releases it vertically above the bottle. In contrast to the use of cork stoppers, it is not necessary to compress the stopper before inserting it in the bottle neck. Use of the stopper of this invention also avoids the ridges which are formed in such cork stoppers. The sealing of the bottle is carried out by applying a vertical force on the stopper 1 to make it completely penetrate into the neck of the bottle (as shown in FIG. 4). The thicker ends 1*a* and 1*b* being of greater density facilities this operation and avoids on the one hand any deformation of the end in contact with the neck and on the other hand any frictional heating of the stopper during insertion. Further, the increased flexibility of the central part ensures it is compressed to the maximum extent once in the neck of the bottle giving excellent sealing. By reason of the half-height $h$ being greater than the distance $h_1$, the median part of greatest diameter of the stopper is situated below the narrowest zone $d_0$ of the bottle neck so that the stopper is maintained in position in the neck.

As has been noted, each of the ends of the stopper are of greater density and thus relatively rigid. The surface which is in contact with the liquid is impermeable while the opposite surface will not crumble on removal of the stopper by means of a corkscrew.

It is also possible to form the stopper in a barrel shape 6, as shown in FIG. 5. This shape has two bases with equal diameter $d$ and a total distance between the bases of $2h$. The stopper is symmetrical about a median zone of diameter D.

I claim:

1. A bottle stopper having a biconical configuration and formed from foamed plastic comprising a pair of identical truncated conical sections abutting on their bases at a medial plane of the stopper.

2. A bottle stopper according to claim 1 wherein the density of the plastic material at the ends is significantly greater than at the centre as a result of injection moulding with the injection nozzle positioned at the medial plane.

3. A bottle stopper according to claim 1 in combination with a bottle in which the internal diameter of the neck reduces from the entrance to a zone of smallest diameter, in which the diameter of each end of the stopper is less than the diameter of the entrance to the neck.

4. A bottle stopper and bottle according to claim 3 in which the height of each truncated cone is greater than the distance between the neck entrance and the zone of smallest diameter.

5. A bottle stopper and bottle according to claim 3 in which the diameter of the stopper on the medial plane is greater than the diameter of the neck entrance.

* * * * *